United States Patent [19]

Büyükgüclü e of Patent:

[11] Patent Number: 4,775,874

Oct. 4, 1988

[54] MAGNETIC CLOSING AND CONVEYING MECHANISM FOR NON-MECHANICAL PRINTER OR COPIER DEVICES

[75] Inventor: Mehmet A. Büyükgüclü, Munich, Fed. Rep. of Germany

[73] Assignee: Siemens Aktiegesellschaft, Berlin and Munich, Fed. Rep. of Germany

[21] Appl. No.: 46,513

[22] Filed: May 6, 1987

[30] Foreign Application Priority Data

Jun. 20, 1986 [DE] Fed. Rep. of Germany ..... 3620751

[51] Int. Cl.[4] ..... G03G 15/08

[52] U.S. Cl. ..... 355/3 DD; 118/636; 118/655; 355/3 R

[58] Field of Search ..... 355/3 DD, 14 D, 3 R; 118/636, 653, 654–658; 430/120–122; 366/273, 274

[56] References Cited

U.S. PATENT DOCUMENTS

| | | | |
|---|---|---|---|
| 3,333,566 | 8/1967 | Kent | 118/700 |
| 3,522,990 | 8/1970 | Koizumi et al. | 355/3 R |
| 3,712,266 | 1/1973 | Stauffer | 118/655 X |
| 3,717,122 | 2/1973 | Hudson | 118/655 X |
| 3,764,208 | 10/1973 | Takahashi et al. | 355/3 DD |
| 3,927,640 | 12/1975 | Smith | 118/658 |
| 3,930,466 | 1/1976 | Stover | 118/658 |
| 3,954,331 | 5/1976 | Smith | 118/653 X |
| 4,226,525 | 10/1980 | Sakamoto et al. | 355/14 D |

FOREIGN PATENT DOCUMENTS

| | | | |
|---|---|---|---|
| 0010146 | 1/1977 | Japan | 118/657 |
| 0150768 | 11/1981 | Japan | 118/653 |
| 0148773 | 9/1982 | Japan | 355/3 DD |
| 2098094 | 11/1982 | United Kingdom . | |
| 2150052 | 6/1985 | United Kingdom . | |

*Primary Examiner*—A. T. Grimley
*Assistant Examiner*—John G. Smith
*Attorney, Agent, or Firm*—Hill, Van Santen, Steadman & Simpson

[57] ABSTRACT

A magnetic mechanism is provided for a non-mechanical printer or copier device comprising a conveying channel through which a developer mix including magnetic components contained therein flows, so that a plug of developer mix is generated via the magnetic mechanism for closing the conveying channel. The conveying channel contains a rotatable drum containing a magnetic strip and the drum is arranged in the conveying channel such that the one wall of the conveying channel forms a narrow retaining gap together with the drum and the other wall of the conveying channel forms a significantly broader conveying gap together with the drum.

4 Claims, 1 Drawing Sheet

MAGNETIC CLOSING AND CONVEYING MECHANISM FOR NON-MECHANICAL PRINTER OR COPIER DEVICES

BACKGROUND OF THE INVENTION

1. Field of the Invention

The invention is directed to a magnetic mechanism for a non-mechanical printer or copier device 2. Description of the Prior Art In copying device technology and in non-mechanical fast data printers that operate on the principle of electrophotography, charge images are generated on a charge image carrier, for example on a photoconductive drum, and are subsequently inked with a black powder (toner) in a developing station. Given employment of a photoconductive drum, the toner images are subsequently transferred onto standard paper and are fixed there. As a rule, a two-component developer is used for developing, this being composed of ferromagnetic carrier particles and of toner particles. The developer mix, for example, is conducted past the charge image by means of a magnet brush arrangement, the toner particles remaining adhering to the charge image due to electrostatic forces. Such a developing station is disclosed, for example, by German patent No. 21 26 667.

Over the course of time, a developer mix can lose its triboelectric properties and it must therefore be replaced with a new developer mix at the end of its useful life. This replacement of the developer mix must be simple to carry out.

U.S. Pat. No. 3,764,208 further discloses an apparatus for removing the developer mix from a developing station of an electrophotographic apparatus. This means contains a developer drum and a mixing screw at whose end the off-take opening comprising a tube for connection of a bottle for the acceptance of the developer mix is arranged in the floor of the developing station. In order to remove the developer mix, the rotational direction of the mixing screw and of the developer drum is reversed in order to convey the developer mix to the off-take opening.

In such apparatus, there is the risk that mix can unintentionally flow out in the region of the off-take pipe. When closing and removing the bottle, there is a risk of contamination for the environment. A complete emptying is not possible since the screw and the appertaining screw channel must always have a defined distance relative to one another. The overall emptying operation lasts a relatively long time. As experience has shown, toner deposits can form at the screws which can burst off.

U.S. Pat. No. 3,930,466 further discloses a developing station for an electrophotographic apparatus wherein a magnetic mechanism is arranged between a supply region and the actual conveying region of the developing station as a closing means. The magnetic mechanism is composed of a rotatably seated permanent magnet which can be swiveled or rotated into alignment with the actual throughput channel for the developer mix. When it is swivelled in, a plug of developer mix which closes the channel is formed in the throughput channel.

The only thing possible with such a magnetic mechanism is an interruption of the developer mix in the conveying channel.

SUMMARY OF THE INVENTION

An object of the invention is to fashion an apparatus of the type initially set forth above such that both a closing of the conveying channel as well as a metered conveying of a developer mix in the conveying channel are possible. The closing and the conveying of the developer mix should ensue given the gentlest possible mechanical treatment of the mix.

In an apparatus of the type described, this object is achieved where the magnetic mechanism comprises a conveying channel through which a developer mix with magnetic particles flows, whereby a plug of developer mix is generated via the magnetic mechanism for closing the conveying channel, wherein a rotatable drum containing a magnetic ledge, this drum being arranged such in the conveying channel surrounding the drum that the one wall of the conveying channel forms a narrow retaining gap together with said drum and the other wall of said conveying channel forms a significantly conveying gap together with said drum.

Preferably a stripper ledge is arranged at the entry region of the retaining gap. Further the magnetic mechanism for removing the developer mix may be arranged at the floor of a developing station of the printer or copying device. The magnetic ledge may be composed of a plurality of individual magnets.

A rotatable drum containing a magnetic ledge is arranged in a conveying channel which, for example, can be the connecting channel between the actual developing station and a collecting container, such that one wall of the conveying channel forms a narrow retaining gap with the drum and the other wall of the conveying channel forms a significantly broader conveying gap with the drum. The conveying channel can be closed in non-contacting fashion, that is, without the drum contacting a channel wall, in a simple way; on the other hand, the toner in the conveying channel can be conveyed in metered fashion via the drum.

The developer mix can be quickly and gently removed from the developer station with such a mechanism. Moreover, the mechanism can be employed, for example, in order to supply developer mix to the developing station in metered fashion.

An embodiment of the invention is shown in the drawing and shall be set forth in greater detail below by way of example.

DESCRIPTION OF THE PREFERRED EMBODIMENTS

Figure 1:
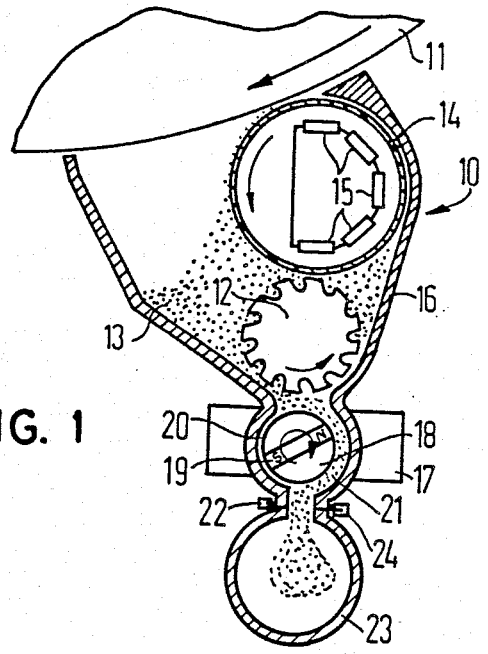
FIG. 1 shows a schematic illustration of the magnetic closing and conveying mechanism in the developing station of an electrophotographic printer means in a partial sectional view.
Figure 2:
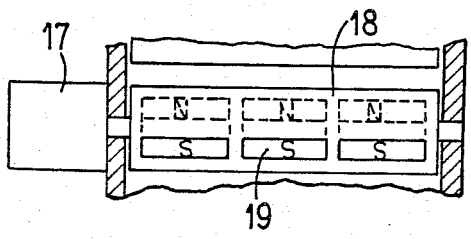
FIG. 2 is a partial side sectional view of the magnetic closing and conveying mechanism of FIG. 1.

In a printer apparatus operating on the principle of electrophotography, a developing station 10 is arranged next to a charge image carrier 11, for example a photoconductive drum. The developing station 10, for example, contains a paddle wheel 12 for mixing the developer mix composed of two components, this developer mix being composed of ferromagnetic carrier particles and of the actual toner particles inking the charge carrier 11. For inking the photoconductive drum, a thoroughly mixed developer mix 13 is brought into the environment of the photoconductive drum 11, this being accomplished with the assistance of a magnetic drum arrangement comprising a rotating hollow cylinder 14 with permanent magnets 15 permanently arranged therein. The overall mixing and conveying devices for the toner are motor-driven in a known way, this not being shown here in detail.

The developer station is composed of a trough-like housing 16 of, for example, impact-resistant plastic, which extends in axial direction along the photoconductive drum 11 in accord with the width of this photoconductive drum. An emptying opening is situated at the floor of the housing 16, a rotatable drum 18, electrically drivable via an electric motor 17, being contained therein. This rotatable drum 18 contains a permanent magnet ledge 19 which extends over the full length of the drum 16 and which, for example, can also be fashioned of individual permanent magnet ledge segments. It can be composed of a barium ferrite magnet.

The drum 18 is arranged such within an emptying opening forming a conveying channel that the one wall of the conveying channel forms a narrow retaining gap 20 together with the drum 18 and the other wall of the conveying channel forms a significantly wider conveying gap 21 together with the drum. A stripping ledge 22 is provided at the input of the retaining gap 20.

A collecting container 23 for the acceptance of the developer mix 13 removed from the developing station 10 is secured under the emptying opening, being secured via a fastening mechanism 24. The collecting container 23, for example, can be composed of an elastic, bag-like container which is secured to the emptying opening via corresponding spring clamps 24.

The overall apparatus then operates in the following way. During normal operation of the electrophotographic printer means, the developing station is filled with developer mix and the drum 18 including its magnetic ledge 19 arranged therein is situated in the position shown in the Figure. A plug of ferromagnetic carrier particles is thereby formed in the conveying gap 21 in the proximity of the north pole of the drum 18 referenced N; this plug preventing the emergence of the developer mix out of the developing station.

When the developer mix 13 is to be removed from the developing station with the described mechanism, then the drum 18 is rotated in a simple way with the assistance of the motor mechanism 17. In combination with the clearance of the conveying gap 21, the rotational speed of the drum 18 or, respectively, the size of its circumference defines the conveying capacity of the developer mix in the conveying channel. Developer particles which may potentially adhere to the drum 18 are stripped off by the stripper ledge 22.

Instead of the flexible container 23, it is also possible to provide a rigid container which is in communication with a collecting container via a suction mechanism. Conveying screws can also be arranged in the container or, on the other hand, the developer mix collected in the container is removed by underpressure via a suction means.

As is apparent from the foregoing specification, the invention is susceptible to being embodied with various alterations and modifications which may differ particularly from those that have been described in the preceding specification and description. It should be understood that I wish to embody within the scope of the patent warranted hereon all such modifications which reasonably and properly come within the scope of my contribution to the art.

I claim as my invention:

1. A magnetic mechanism comprising a rotatable drum containing a magnetic ledge, this drum being arranged in a conveying channel formed between two opposed walls through which developer mix with magnetic components therein flows, in a non-mechanical printer or copier device such that one of said walls of the conveying channel forms a narrow retaining gap together with said drum and the other of said walls of said conveying channel forms a significantly broader conveying gap together with said drum, wherein a plug of developer mix is generated via the magnetic mechanism for closing the conveying channel.

2. A magnetic mechanism according to claim 1, wherein an entry region is formed at said retaining gap where said drum rotates into said gap and a stripper ledge is arranged at the entry region of the retaining gap.

3. A magnetic mechanism according to claim 1, wherein the magnetic mechanism for removing the developer mix is arranged at the floor of a developing station of a non-mechanical printer or copying device.

4. A magnetic mechanism according to claim 1, wherein the magnetic ledge is composed of a plurality of individual magnets.

* * * * *